US007422612B2

(12) United States Patent
Pietschner

(10) Patent No.: US 7,422,612 B2
(45) Date of Patent: Sep. 9, 2008

(54) OIL SEPARATOR FOR THE SEPARATION OF OIL FROM THE CRANKCASE VENTILATION GAS OF AN INTERNAL COMBUSTION ENGINE

(75) Inventor: Sieghard Pietschner, Greven (DE)

(73) Assignee: Hengst GmbH & Co., KG, Muenster (DE)

( * ) Notice: Subject to any disclaimer, the term of this patent is extended or adjusted under 35 U.S.C. 154(b) by 561 days.

(21) Appl. No.: 10/522,308

(22) PCT Filed: Jul. 24, 2003

(86) PCT No.: PCT/EP03/08106

§ 371 (c)(1),
(2), (4) Date: Oct. 20, 2005

(87) PCT Pub. No.: WO2004/013468

PCT Pub. Date: Feb. 12, 2004

(65) Prior Publication Data

US 2006/0090737 A1 May 4, 2006

(30) Foreign Application Priority Data

Jul. 26, 2002 (DE) ..... 202 11 329 U

(51) Int. Cl.
*B01D 45/12* (2006.01)

(52) U.S. Cl. ..... 55/309; 55/345; 55/459.1; 55/466; 55/DIG. 19; 123/573

(58) Field of Classification Search ..... 55/309, 55/345, 423, 431, 459.1, 466, DIG. 19; 123/572, 123/573
See application file for complete search history.

(56) References Cited

U.S. PATENT DOCUMENTS

| | | | | |
|---|---|---|---|---|
| 2,701,056 | A | 2/1955 | Morton | |
| 4,816,156 | A | 3/1989 | Brombach et al. | |
| 5,239,972 | A * | 8/1993 | Takeyama et al. | 123/573 |
| 5,450,835 | A * | 9/1995 | Wagner | 123/573 |
| 6,279,556 | B1 | 8/2001 | Busen et al. | |
| 6,626,163 | B1 * | 9/2003 | Busen et al. | 123/572 |

FOREIGN PATENT DOCUMENTS

| | | |
|---|---|---|
| DE | 199 18 311 A1 | 11/2000 |
| WO | WO 00/68548 | 11/2000 |

* cited by examiner

*Primary Examiner*—Robert A Hopkins
(74) *Attorney, Agent, or Firm*—Greer, Burns & Crain, Ltd.

(57) ABSTRACT

The invention relates to an oil separator for the separation of oil from the crankcase ventilation gas of an internal combustion engine, comprising a housing wherein a separating element is arranged, comprising an inlet for gas to be cleaned, an outlet for cleaned gas and an outlet for separated oil. The novel oil separator is characterized by a crude gas area of the housing adjacent to the inlet and provided with an oil sink wherein coarse oil carried by the incoming gas flow is deposited; also characterized in that the oil separator comprises, in addition to the separating element, a coarse oil cyclone whose inflow opening is located at the same level as the oil sink therein, and in that the separating element has an inflow opening which is spatially located above the inflow opening of the coarse oil cyclone.

12 Claims, 3 Drawing Sheets

OIL SEPARATOR FOR THE SEPARATION OF OIL FROM THE CRANKCASE VENTILATION GAS OF AN INTERNAL COMBUSTION ENGINE

The present invention relates to an oil separator for the separation of oil from the crankcase ventilation gas of a combustion engine, comprising a housing and a separation element arranged therein, an inlet for gas to be cleaned, an outlet for cleaned gas, and an outlet for separated oil.

Oil separators for the intended use mentioned have long been in practical service and are known in various embodiments, for example from DE-A 199 12 271 or from DE-U 200 09 605. Depending on the construction of the machine, there may be predetermined structural situations where, in some operating states, large-size fluid drops or splashes from the crankcase of the combustion engine enter into the oil separator.

In the known separators, these coarse liquid constituents from the crankcase are then, in a surge-like or continuous manner, entering the separation element where they cause a high load and, thus, reduced efficiency of the separation element. Therein, it is to particular disadvantage that parts of the coarse-particle fluid may even be entrained over to the clean side of the oil separator. This arises the risk that the liquid constituents entrained over to the clean-gas side cause a deterioration of the function of or even damage to the associated combustion engine, because the outlet of the oil separator is usually connected to the intake section of the combustion engine.

As described in DE-U 296 05 425, this problem is solved in a known manner in that the oil from a housing region of the oil separator is drained upstream of the separation element by means of a hole with a special oil drain valve in the form of a reed valve. This oil drain valve, however, requires a great deal of technical expenditure for its manufacture and installation. Moreover, it also requires comprehensive quality control which markedly increases the final manufacturing cost as a whole when oil separators are produced in bulk. Furthermore, the reed valve opens only if the associated combustion engine is not running so that the oil is discharged from the housing only discontinuously. In case of longer operating times without any interruption, this may still cause the problems described above, with oil being entrained over to the clean side of the separation element.

For that reason, the present invention aims at creating an oil separator of the aforementioned type, which obviates the drawbacks disclosed and which ensures that coarse-particle oil is also reliably separated without passing over to the clean side of the oil separator and without causing an overload of the separation element. At the same time, it should also be ensured that bypass routes for the crankcase ventilation gas, through which the crankcase ventilation gas might pass from the dirty side over to the clean side without having been cleaned, are prevented from developing inside the oil separator.

This problem is solved with the invention by an oil separator of the aforementioned type, characterized in that an uncleaned-gas region of the housing, that is arranged adjacent to the inlet, is designed with an oil sink where coarse-particle oil carried along with the inflowing gas flow deposits, the oil separator comprises not only the separation element but also a coarse-particle-oil cyclone, the inflow opening of which is positioned in the oil sink at the same level as the latter, and the separation element comprises an inflow opening that is spatially positioned at a level above the inflow opening of the coarse-particle-oil cyclone.

The oil sink provided according to the invention forms in the oil separator a first separation stage that separates coarse-particle oil in the form of oil drops or splashes from the crankcase ventilation gas. The coarse-particle oil that accumulates in the oil sink in the oil separator is discharged through the coarse-particle-oil cyclone because the latter's inflow opening is positioned at the level of the oil sink. In the coarse-particle-oil cyclone, the oil is separated from the partial crankcase ventilation gas flow that is also entering into the coarse-particle-oil cyclone. The remaining other partial flow of the crankcase ventilation gas is supplied to the separation element where it is, in a manner that is known as such, separated from finer oil droplets and oil mist that are carried along without this process of coarse-particle-oil separation being impaired. The coarse-particle oil from the coarse-particle-oil cyclone and the oil from the separation element, on the one hand, and the cleaned partial flows of the crankcase ventilation gas from which the oil has been removed, on the other hand, can then each be supplied to the associated outlet. This reliably ensures that such a volume of coarse-particle oil that would cause coarse-particle oil to pass over to the clean side of the oil separator in a detrimental manner can, by no means, accumulate in the housing of the oil separator. At the same time, the oil separator according to the invention avoids any bypass route through which uncleaned crankcase ventilation gas might pass from the dirty side to the clean side of the oil separator. An undesired additional pressure drop is not caused by the additionally provided coarse-particle-oil cyclone since the latter reduces rather than increases the total flow resistance of the oil separator. Hence, the oil separator according to the invention achieves an efficiency that is, all in all, very high, wherein this efficiency is ensured both for the separation of fine oil droplets and oil mist in the separation element and for the separation of coarse-particle oil in the coarse-particle-oil cyclone. For proper functioning, the oil separator according to the invention does not require any moving component parts, in particular a valve, the manufacture and assembly of which are comprehensive and which, sometimes, fail to function reliably.

In a further embodiment, it is provided that the coarse-particle-oil cyclone and the separation element are designed such that a first partial flow of the crankcase ventilation gas flowing through the coarse-particle-oil cyclone is smaller than the remaining second partial flow of the crankcase ventilation gas flowing through the separation element. In its design, the coarse-particle-oil cyclone, may, to advantage, be formed such that it has to put through only a relatively small partial flow of crankcase ventilation gas, thus requiring only small free space. Hence, it is usually possible to incorporate the additional coarse-particle-oil cyclone including the coarse-particle-oil sink even in already existing oil separators or the housings thereof, without the housing of the oil separator having to be increased in size and without the separation element having to be reduced in size.

In order to achieve high-efficiency separation of the coarse-particle oil in the oil sink from the crankcase ventilation gas flowing into the housing, it is preferably provided that the uncleaned-gas region of the housing, that is arranged adjacent to the inlet, is equipped with means to decelerate and/or redirect the flow of the crankcase ventilation gas to be cleaned. In the simplest case, the means to decelerate the flow can comprise an increase in the cross-section of the flow path, the realization of which can easily be achieved. For example, baffle plates or deflecting walls or vanes that are arranged in the flow path can be used for redirection of the flow. Whether separately or in combination, both means ensure efficient separation and collection of the coarse-particle oil from the inflowing crankcase ventilation gas in the oil sink.

A further development of the oil separator according to the invention provides that the coarse-particle-oil cyclone comprises a gas outflow opening that is formed by an inner pipe projecting into the coarse-particle-oil cyclone from above, said inner pipe being connected to the outlet for cleaned gas. As is the case in a usual cyclone, the gas is separated from the oil carried along by the developing vortex flow in this embodiment of the coarse-particle-oil cyclone as well. The gas is then discharged upwards through the inner pipe and is, in this manner, supplied to the cleaned-gas region of the oil separator and, from there, to the latter's outlet for cleaned gas. The oil separated in the coarse-particle-oil cyclone flows down, in particular by virtue of gravity, and enters the oil outlet region of the oil separator through an oil outlet opening that is, as usual, provided at the bottom of the coarse-particle-oil cyclone. The vortex flow developing in the coarse-particle-oil cyclone ensures that, to a very high degree, only oil exits from the coarse-particle-oil cyclone through the oil outlet opening, whereas the cleaned gas from which the coarse-particle oil has been removed exits the coarse-particle-oil cyclone in an oil-free state in an upward and, thus, opposite direction. Any undesired bypass flow of uncleaned gas through the coarse-particle-oil cyclone from the uncleaned-gas side to the cleaned-gas side of the oil separator is, hence, prevented here.

An alternative embodiment of the oil separator according to the invention provides that the coarse-particle-oil cyclone is closed at its top and that the oil outflow opening at the bottom side of the coarse-particle-oil cyclone also forms the latter's gas outflow opening, wherein this outflow opening is connected both to the outlet for separated oil and to the outlet for cleaned gas. This embodiment of the oil separator is, in particular, suitable for cases of application where large amounts of coarse-particle oil are present at the gas inlet of the oil separator. Since, herein, gas is not removed from the coarse-particle-oil cyclone directly into the cleaned-gas region, there is neither any danger of drops of coarse-particle oil passing from the coarse-particle-oil cyclone into the cleaned-gas region. Instead, the gas is removed from the coarse-particle-oil cyclone through the latter's oil outlet opening, together with the oil, wherein the desired separation of gas and oil is ensured here as well. Herein, the oil flows down across the internal surface of the coarse-particle-oil cyclone and drips through the oil outlet opening and into the oil outlet region of the oil separator. The cleaned gas from which the coarse-particle oil has been removed flows out of the coarse-particle-oil cyclone through the same outlet opening and is subsequently removed from the oil drain region of the oil separator through an appropriate flow connection and supplied to the gas outlet for cleaned gas of the oil separator.

Preferably, an already existing connection, i.e. an internal oil return line that connects an outlet-side cleaned-gas region of the housing to the latter's oil outlet region, is used for the above-mentioned removal of the cleaned gas that exits the coarse-particle-oil cyclone through the latter's oil outlet opening. A similar return line is, for example, known from DE-U 299 08 116.

In this manner, the already existing oil return line through which the oil can flow from the cleaned-gas region into the oil outlet region is used for ventilating cleaned gas from the oil outlet region into the cleaned-gas region during running operation of the combustion engine. For that reason, it is not necessary to provide additional line connections in this embodiment of the oil separator.

The separation element of the oil separator can comprise various embodiments. A first preferred embodiment provides that the separation element is formed by one or more cyclones.

An embodiment of the oil separator alternative thereto proposes that the separation element is formed by one or more coalescers.

Both embodiments of the separation element permit to achieve high-efficiency separation of the oil mist that is present in the form of finest and fine oil droplets and that enters the oil separator together with the uncleaned gas. The coarse-particle oil is separated through the oil sink and the additionally provided coarse-particle-oil cyclone, independently of the particular embodiment of the separation element.

Furthermore, it is preferably provided that the separation element, together with the coarse-particle-oil cyclone, is formed as an insert that can be inserted in and can be removed from the housing. This facilitates rational manufacture and assembly of the oil separator. Moreover, one of different separation elements can, optionally, be inserted if the housing of the oil separator is predetermined. This permits flexible adaptation of the oil separator to different cases of application and requirements.

In order to concentrate as many functions within the oil separator as possible, it is further provided that a pressure limiting valve is integrated in the housing between the latter's uncleaned-gas region and cleaned-gas region. This pressure limiting valve ensures that a maximum permissible pressure on the uncleaned-gas side and, thus, in the crankcase of the associated combustion engine cannot be exceeded.

To ensure that the extra expenditure required for mounting of the pressure limiting valve provided is as low as possible, the pressure limiting valve is, preferably, formed as a part of the insert.

A further measure for integration of an additional function in the oil separator is to integrate a vacuum pressure regulating valve in the cleaned-gas region of the housing. In a manner that is known as such, this vacuum pressure regulating valve ensures that the pressure in the crankcase of the associated combustion engine does not fall below a lower pressure limit value, even if a very low pressure, hence a high vacuum pressure, is present in the intake section of the combustion engine, said intake section being connected to the cleaned-gas side of the oil separator.

Executive examples of the invention will be illustrated below by means of a drawing, in which.

Figure 1:
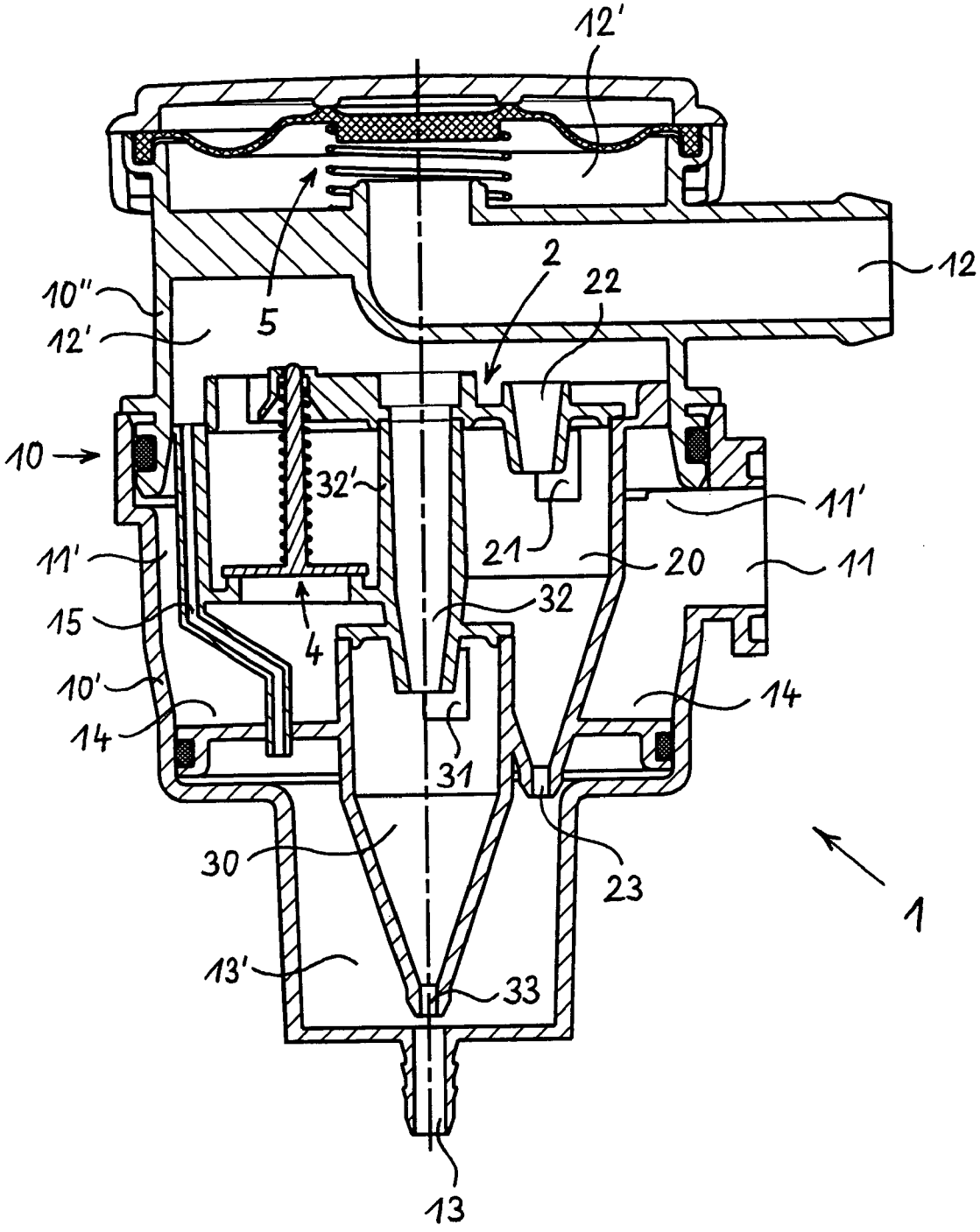
FIG. 1 is a vertical section of an oil separator in a first embodiment.

As is shown in FIG. 1 of the drawing, the represented executive example of an oil separator 1 comprises a two-piece housing 10 with a lower housing part 10' and an upper housing part 10" that is connected thereto in a sealing manner. To its upper right, the lower housing part 10' is provided with a gas inlet 11 that is usually connected to a line coming from the crankcase of an associated combustion engine. To its right, the upper housing part 10" is provided with a gas outlet 12 that is usually connected to the intake section of the associated combustion engine via a line. An oil outlet 13 that is usually connected to the oil pan of the associated combustion engine via a line is provided at the bottommost end of the lower housing part 10'.

A cyclone 20 is arranged as separation element inside the oil separator housing 10. This cyclone 20 is provided to separate oil mist from the crankcase ventilation gas that flows through the gas inlet 11 and into an uncleaned-gas region 11' of the oil separator 1. With the combustion engine being in operation, a pressure difference between the gas inlet 11 and the gas outlet 12 causes a vortex flow to develop in the cyclone 20, said vortex flow ensuring that the oil droplets forming the oil mist settle down on the internal surface of the wall of the cyclone 20, while the cleaned gas from which the oil mist has been removed accumulates in the center of the cyclone 20.

From there, the cleaned gas is supplied upwards through a gas outflow opening 22 in the form of an inner pipe and out of the cyclone 20 and into the cleaned-gas region 12' in the upper part 10" of the housing 10. From there and via a vacuum pressure regulating valve 5 of generally known design that is provided in the upper housing part 10", the cleaned gas flows to the gas outlet 12 and, from there, into the intake section of the associated combustion engine. The separated oil flows down, in particular by virtue of gravity, and through an oil outlet opening into an oil outlet region 13' of the housing 10, said oil outlet region 13' being arranged upstream of the oil outlet 13. Through the oil outlet 13, the oil can flow via a siphon that is not shown or a drain valve into the oil pan of the combustion engine.

Here, a lower part of the uncleaned-gas region 11' that is arranged inside the housing 10 of the oil separator 1 below the gas inlet 11 is formed as oil sink 14. Coarse-particle oil, hence particularly oil that is transported from the crankcase ventilation gas to the gas inlet 11 in the form of larger-size drops and penetrating oil, accumulates in said oil sink 14. In order to support separation and settlement of the coarse-particle oil, the flow cross-section of the housing 10 is increased in a step adjacent to the latter's inlet 11, thus ensuring a marked flow deceleration. As a result, the coarse-particle oil, for the most part, deposits in the oil sink 14 before the crankcase ventilation gas enters into an inflow opening 21 of the cyclone 20 that forms the separation element.

Separation of the coarse-particle oil is additionally supported by this inflow opening 21 being positioned at a higher level as compared with the gas inlet 11. Hence, the gas inflow opening 21 is positioned in the upper section of the uncleaned-gas region 11', which, although reached by the oil mist together with the crankcase ventilation gas, is not reached by the larger-size oil drops. Rather, the latter deposit as coarse-particle oil in the oil sink 14.

In addition, a coarse-particle-oil cyclone 30 is provided in order to remove the coarse-particle oil from the oil sink 14, while simultaneously avoiding an undesired flow path for uncleaned crankcase ventilation gas from the uncleaned-gas region to the cleaned-gas region of the oil separator 1. This coarse-particle-oil cyclone 30 is positioned at a lower level as compared with the separation element, here the cyclone 20, in the lower section of the lower housing part 10'. An inflow opening 31 of the coarse-particle-oil cyclone 30 is positioned at the same level as the oil sink 14, so that the coarse-particle oil that has deposited in the oil sink 14 enters through this inflow opening 31 and into the interior region of the coarse-particle-oil cyclone 30, together with a smaller partial flow of the crankcase ventilation gas. In the coarse-particle-oil cyclone 30, oil and cleaned gas are separated in the known manner. By virtue of gravity, the oil flows down across the internal surface of the coarse-particle-oil cyclone 30 and enters through an oil outlet opening 33 into the oil drain region 13' of the oil separator 1, said oil drain region 13' forming the lower section of the lower housing part 10'. From there, the oil can flow off through the oil outlet 13 and to the oil pan of the associated combustion engine. The cleaned gas from which the coarse-particle oil has been removed accumulates in the center of the coarse-particle-oil cyclone 30, from where it flows upwards through the latter's gas outflow opening 32 and into the cleaned-gas region 12'. Here, the gas outflow opening 32 is formed by an inner pipe 32' that connects the interior region of the coarse-particle-oil cyclone 30 to the cleaned-gas region 12'.

Furthermore, a pressure limiting valve 4 and a vacuum pressure regulating valve 5 are each arranged in the interior region of the oil separator housing 10, in addition to the cyclone 20 and the coarse-particle-oil cyclone 30. These valves are of a design that is known as such and are provided to maintain the pressure in the crankcase of the associated combustion engine within a permissible pressure range from a lower to an upper pressure limit value.

As is further shown in FIG. 1, the cyclone 20, the oil sink 14, the additional coarse-particle-oil cyclone 30, and the pressure limiting valve 4 are comprised to form an insert 2 forming a prefabricated component. With the upper housing part 10" being removed, said insert 2 can be inserted in the housing 10 and removed from the housing 10. In this manner, the housing 10 of the oil separator 1 can, optionally, be provided with one of several differently designed inserts. For example, a modified insert 2 can comprise a multiple cyclone with several smaller cyclones or a coalescer in the stead of the single cyclone 20.

Finally, FIG. 1 shows an internal oil return line 15 that connects the cleaned-gas region 12' to the oil outlet region 13'. If necessary, any occurring oil or condensate can flow out of the cleaned-gas region 12' and down into the oil drain region 13' through said internal oil return line 15. In this manner, oil that has, maybe, nevertheless been entrained into the cleaned-gas region 12' and has deposited there is, by appropriately designing the oil return line 15, supplied into the oil outlet region 13' even during operation of the combustion engine, before it can enter into the intake region of the associated combustion engine through the gas outlet 12, causing malfunctions there.

In the executive example of the oil separator 1 according to FIG. 1, the cyclone 20 and the coarse-particle-oil cyclone 20 have approximately the same physical size.

Figure 2:
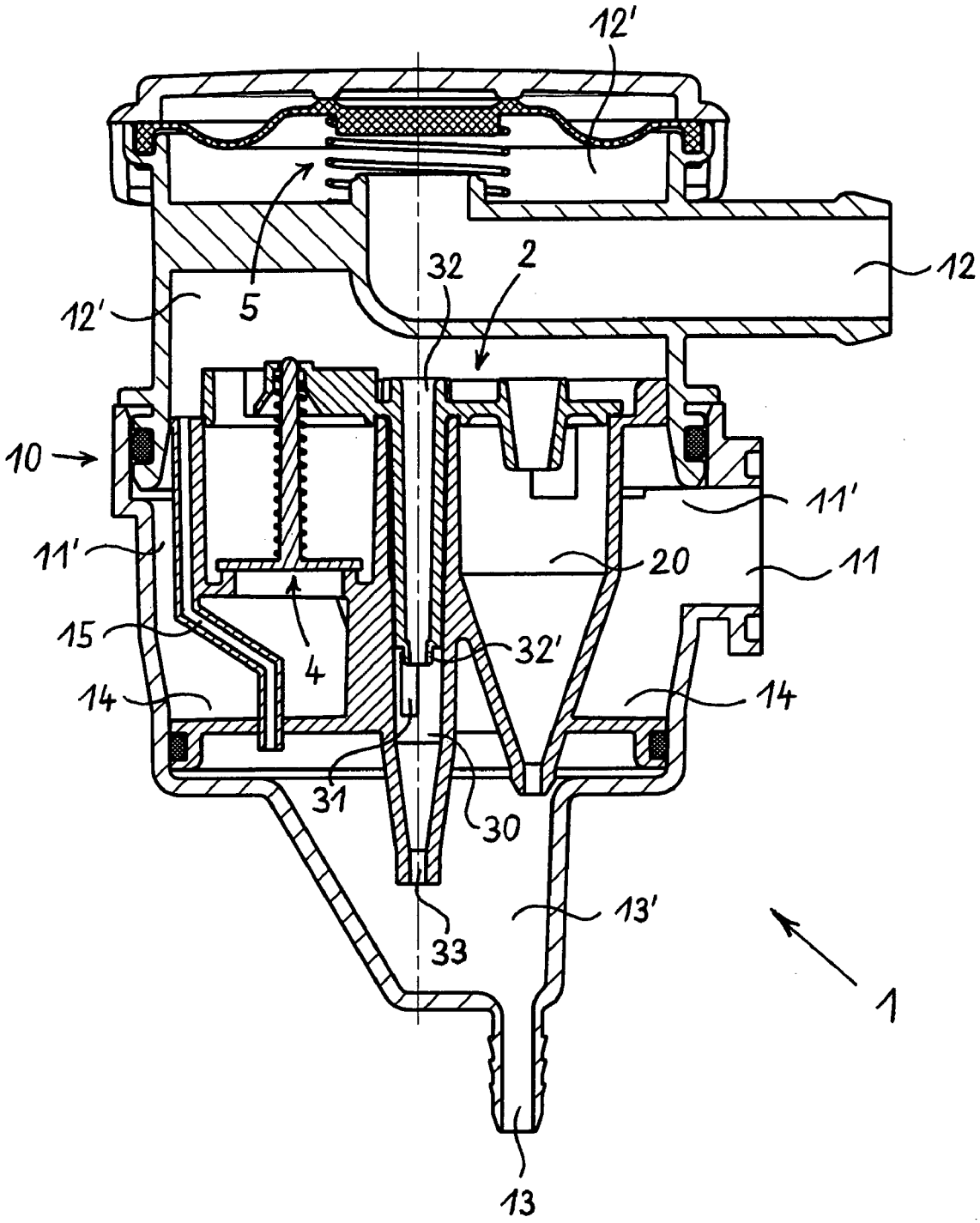
FIG. 2 is also a vertical section of the oil separator in a second embodiment.

Contrary thereto, the executive example of the oil separator 1 according to FIG. 2 is provided with a coarse-particle-oil cyclone 10, the physical size of which is considerably smaller than that of the cyclone 20 that forms the actual separation element. As a result, only a relatively small partial flow of the crankcase ventilation gas flows through the coarse-particle-oil cyclone 30. Here, by far the major part of the crankcase ventilation gas flows through the cyclone 20 where it ensures efficient separation of even finest oil droplets forming the oil mist that is carried along in the crankcase ventilation gas. An essentially smaller partial flow of the crankcase ventilation gas suffices for separation of the coarse-particle oil having deposited in the oil sink 14, this having a positive effect on the separation efficiency of the oil separator as a whole. Moreover, the coarse-particle-oil cyclone 30, thus, requires only a small free space that can be found in the housing 10 without any problem and without the housing 10 having to be increased in size or the actual separation element, here the cyclone 20, having to be reduced in size to achieve this.

As compared with FIG. 1, the arrangement of the oil sink 14, the cyclone 20 as well as the pressure limiting valve 4 and the vacuum pressure regulating valve 5 is the same as in the executive example of the oil separator 1 according to FIG. 2. Here, the physical size of the coarse-particle-oil cyclone 30 is essentially smaller, in particular with regard to its diameter. But here as well, the inflow opening 31 is still arranged at the level of the oil sink 14, so that the oil having deposited in the area of the oil sink 14 enters into the coarse-particle-oil cyclone 30 reliably and completely. Here as well, coarse-particle oil and gas are separated in the coarse-particle-oil cyclone 30. The cleaned gas flows through the inner pipe 32' forming the gas outflow opening 32 and up into the cleaned-gas region 12'. By virtue of gravity, the coarse-particle oil that is separated from the partial flow of the crankcase ventilation gas in the coarse-particle-oil cyclone 30 flows down through the oil outlet opening 33 and into the oil outlet region 13' of the oil separator 1.

Figure 3:
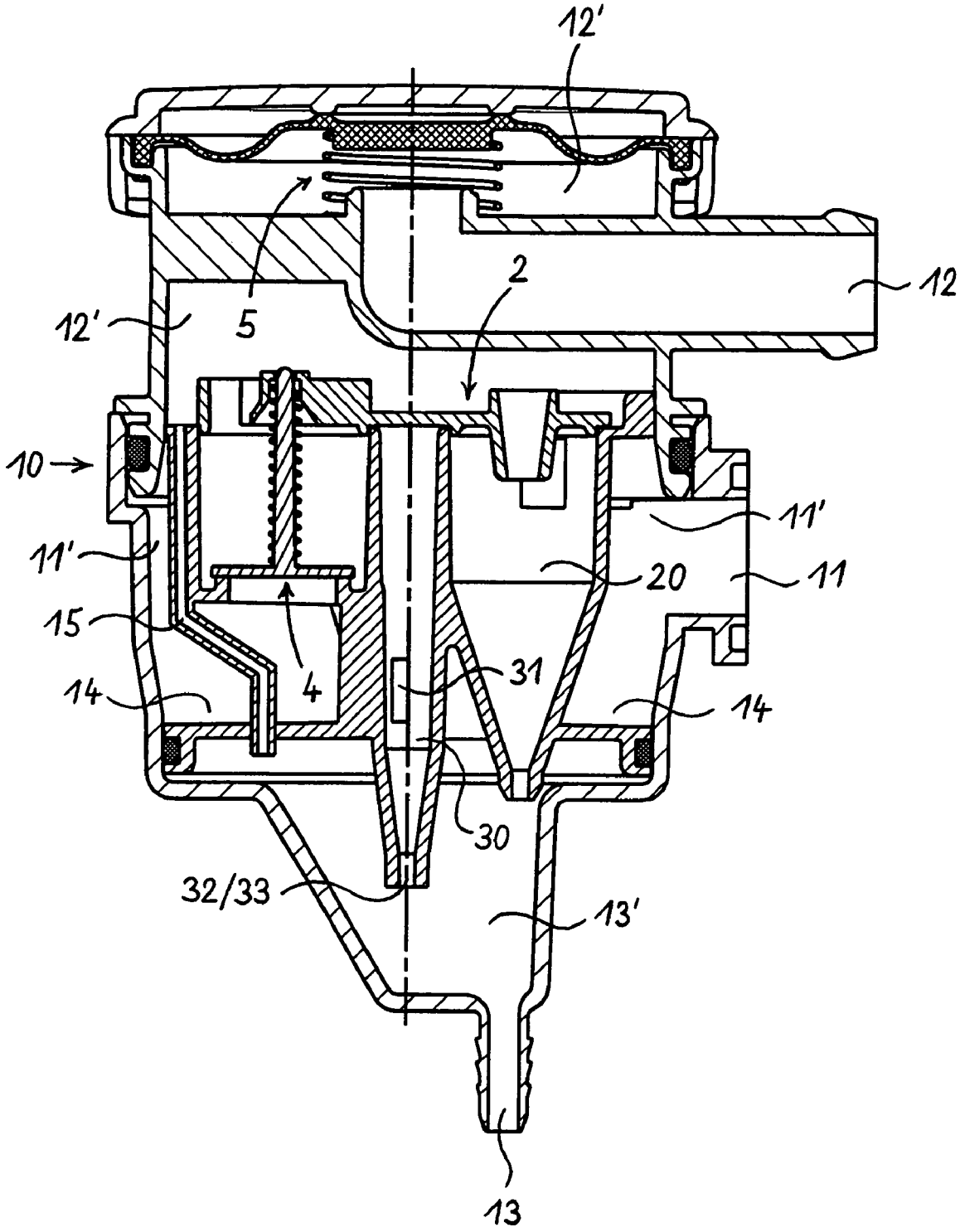
FIG. 3 is also a vertical section of the oil separator in a third embodiment.

Finally, the executive example of the oil separator 1 according to FIG. 3 comprises a coarse-particle-oil cyclone 30 that is, contrary to the two executive examples of the oil separator 1 described above, closed at its top. With this coarse-particle-oil cyclone 30, the inflow opening 31 is again arranged at the same level as the oil sink 14 existing here as well, so that the coarse-particle oil having deposited there, together with a smaller partial flow of the crankcase ventilation gas, enters into the interior region of the coarse-particle-oil cyclone 30, if the associated combustion engine is in operation with a pressure difference existing between the uncleaned-gas region 11' and the cleaned-gas region 12'. Here as well, a cyclone vortex flow depositing the oil drops on the internal surface of the coarse-particle-oil cyclone 30 develops in the interior region of the coarse-particle-oil cyclone 30. By virtue of gravity, the deposited coarse-particle oil flows from the internal surface of the coarse-particle-oil cyclone 30 down through the oil outlet opening 33 and enters into the oil outlet region 13' of the oil separator 1.

In this embodiment of the oil separator 1, the cleaned gas cannot exit the coarse-particle-oil cyclone 30 in an upward direction, because the upper end of the coarse-particle-oil cyclone 30 is closed. Instead, the cleaned gas also exits the coarse-particle-oil cyclone 30 through the oil outlet opening 33 positioned at the bottom. Hence, the cleaned gas enters into the oil outlet region 13' here. From there, the cleaned gas flows through the internal oil return line 15 and up into the cleaned-gas region 12'. As a result, the internal oil return line 15 here has, to advantage, a dual function, and an additional line is not required for supplying the cleaned gas out of the oil outlet region 13' and into the cleaned-gas region 12'.

This embodiment of the oil separator 1 with a coarse-particle-oil cyclone 30 that is closed at its top is to particular advantage in that coarse-particle oil is prevented from being entrained or from passing out of the coarse-particle-oil cyclone 30 directly up into the cleaned-gas region 12', even if the amount of coarse-particle oil occurring in the inflowing crankcase ventilation gas is very great. But here as well, the coarse-particle oil is, at the same time, separated from the partial flow of the crankcase ventilation gas that transports the coarse-particle oil through the coarse-particle-oil cyclone 30, so that only cleaned gas enters into the cleaned-gas region 12' here as well. The separated oil is collected in the oil outlet region 13' from where it is returned to the oil pan of the combustion engine through the oil outlet 13.

In its remaining parts, the oil separator 1 according to FIG. 3 is the same as that of the examples according to FIGS. 1 and 2 described above.

The invention claimed is:

1. An oil separator for the separation of oil from the crankcase ventilation gas of a combustion engine, comprising:

a housing with a separation element arranged therein, an inlet for gas to be cleaned, an outlet for cleaned gas, and an outlet for separated oil, an uncleaned-gas region provided in said housing adjacent to the inlet, and containing an oil sink arranged to receive coarse-particle oil that is carried along with an inflowing gas flow, a coarse-particle-oil cyclone provided in said housing and having an inflow opening positioned in the oil sink at the same vertical level as the oil sink, and the separation element comprising an inflow opening that is spatially positioned at a vertical level above the inflow opening of the coarse-particle-oil cyclone.

2. An oil separator according to claim 1, wherein the coarse-particle-oil cyclone and the separation element are configured such that a first partial flow of the crankcase ventilation gas is directed through the coarse-particle-oil cyclone and a larger remaining second partial flow of the crankcase ventilation gas is directed through the separation element.

3. An oil separator according to claim 1, wherein the uncleaned-gas region of the housing is provided with a structure to cause an acceleration flow of the gas to be cleaned.

4. An oil separator according to claim 1, wherein the coarse-particle-oil cyclone comprises a gas outflow opening that is formed by an inner pipe projecting into the coarse-particle-oil cyclone from above, said inner pipe being connected to the outlet for cleaned gas.

5. An oil separator according to claim 1, wherein the coarse-particle-oil cyclone is closed at its top and the oil outflow opening at the bottom side of the coarse-particle-oil cyclone also forms a gas outflow opening, for the coarse-particle-oil cyclone, wherein this gas outflow opening is connected both to the outlet for separated oil and to the outlet for cleaned gas.

6. An oil separator according to claim 5, wherein the connection between the combined oil and gas outflow opening and the outlet for cleaned gas is formed by an internal oil return line that connects an outlet-side cleaned-gas region of the housing to an oil outlet region of the housing.

7. An oil separator according to claim 1, wherein the separation element is formed by one or more cyclones.

8. An oil separator according to claim 1, wherein the separation element is formed by one or more coalescers.

9. An oil separator according to claim 1, wherein a pressure limiting valve is integrated in the housing between the uncleaned-gas region and a cleaned-gas region.

10. An oil separator according to claim 1, wherein a pressure limiting valve is integrated in the housing between the uncleaned-gas region and a cleaned-gas region.

11. An oil separator according to claim 9, wherein a pressure limiting valve is integrated in the housing between the uncleaned-gas region and a cleaned gas region, the pressure limiting valve being formed as a part of the insert.

12. An oil separator according to claim 1, wherein a vacuum pressure regulating valve is integrated in a cleaned-gas region of the housing.

* * * * *